US008249874B2

(12) United States Patent
Moehler et al.

(10) Patent No.: US 8,249,874 B2
(45) Date of Patent: Aug. 21, 2012

(54) SYNTHESIZING SPEECH FROM TEXT

(75) Inventors: Gregor Moehler, Stuttgart (DE); Andreas Zehnpfenning, Stuttgart (DE)

(73) Assignee: Nuance Communications, Inc., Burlington, MA (US)

( * ) Notice: Subject to any disclaimer, the term of this patent is extended or adjusted under 35 U.S.C. 154(b) by 916 days.

(21) Appl. No.: 12/036,971

(22) Filed: Feb. 25, 2008

(65) Prior Publication Data

US 2008/0221894 A1 Sep. 11, 2008

(30) Foreign Application Priority Data

Mar. 7, 2007 (EP) ..... 07103649

(51) Int. Cl.
*G10L 13/06* (2006.01)

(52) U.S. Cl. ..... 704/266; 704/258; 704/260

(58) Field of Classification Search ..... 704/266
See application file for complete search history.

(56) References Cited

U.S. PATENT DOCUMENTS 7,558,732 B2 * 7/2009 Kustner et al. ..... 704/260
2005/0137870 A1 6/2005 Mizutani et al.

FOREIGN PATENT DOCUMENTS

EP 1 213 705 A 6/2002

OTHER PUBLICATIONS

Meron , "Prosodic Unit Selection Using an Imitation Speech Database" 4th ISCA Workshop on Speech Synthesis, 2001, pp. 53-57.*
Hunt et al., "Unit Selection in a Concatenative Speech Synthesis System Using a Large Speech Database", ICASSP 196.*
Campbell, "CHATR: A High-Definition Speech Re-Sequencing System" Acoustical Society of American and Acoustical Society of Japan 3rd Joint meeting, Dec. 1996.*
Raux et al., "A Unit Selection Approach to F0 Modeling and its Application to Emphasis" ASRU 2003.*
A.Aaron et al "Efforts to Make Computers Speak Naturally Will Let Machines Better Communicate Meaning", Scientific American, Jun. 2005, pp. 64-69.

(Continued)

*Primary Examiner* — Vincent P Harper
(74) *Attorney, Agent, or Firm* — Wolf, Greenfield & Sacks, P.C.

(57) ABSTRACT

Speech is synthesized for a given text by determining a sequence of phonetic components based on the text, determining a sequence of target phonetic elements associated phonetic components, determining a sequence of target event types associated with the phonetic components and determining a sequence of speech units from a plurality of stored speech unit candidates by use of a cost function. The cost function comprises a unit cost, a concatenation cost, and an event type cost for each speech unit in the sequence of speech units. The unit cost of a speech unit is determined with respect to the corresponding target phonetic element, while the concatenation cost of a speech unit is determined with respect to adjacent speech units and the event type cost of each speech unit is determined with respect to the corresponding target event type.

23 Claims, 6 Drawing Sheets

OTHER PUBLICATIONS

E.Eide et al "Recent Improvements to the IBM Trainable Speech Synthesis System", Acoustics, Speech and Signal Processing, 2003, Proceedings (ICASSP '03), IEEE Ingternational Conference.

G. Moeher et al "Parametric Modeling of Intonation Using Vector Quantization", Proceedings of 3rd ESCA Workshop on Speech Synthesis, Jenolan Cavas, Australia, 1998.

A.Black, "Comparison of Algorithms for Predicting Accent Placement in English Speech Synthesis", Proceedings of the Spring Meeting of the Acoustical Society of Japan, 1995.

Silverman et al, "TOBI: A Standard for Labeling English Prosody", Proceedings of the 1992 International Conference on Spoken Language Processing, Banff, Oct. 12-16, 1992.

M.Wang et al "Automatiac Classification of Intonational Phase Boundaries", Computer Speech & Language, 6:175-196, 1992.

* cited by examiner

SYNTHESIZING SPEECH FROM TEXT

BACKGROUND OF THE INVENTION

Text to speech systems (TTS) create computer-generated or synthesized speech directly from text input. Concatenative text to speech systems rely on linguistic building blocks called phonemes or phonetic elements and arrange sequences of recorded phonemes (also called speech units at times in the following description) in order to create a voiced representation of a given text. The word 'school', for example, contains four phonemes that are referred to as S, K, OO and L. Languages differ in the number of phonemes they contain. English makes use of about forty distinct phonemes, whereas Japanese has about twenty-five and German forty-four. Just as typesetters once sequenced letters of metal type in trays to create printed words, current text to speech systems sequence recorded speech units to create spoken words.

A concatenative text to speech system is described in Scientific American, June 2005, pages 64 to 69. The article describes a TTS system including a database that contains an average of 10,000 recorded samples, the speech units, of each of the approximately 40 phonemes in the English language. This database was created by recording more than 10,000 sentences voiced by dozens of candidate speakers. The sentences were picked in part for their relevance to real world applications and in part for their diverse phoneme content, which ensured that many examples of all English phonemes were captured in different contexts. When words are combined into sentences, the relative loudness and pitch of each sound changes, based on the speaker's mood, what he or she wants to emphasize, and the type of sentence, e.g. a question or an exclamation. Hence the phoneme samples derived from the sentences can vary significantly, which is reflected in the database.

In order to convert a text into synthesized speech, the above-mentioned TTS system translates the text into the corresponding series of words, whereby ambiguities such as multiple ways of integrating abbreviations, e.g., 'St.' can be an abbreviation for 'Saint' and for 'Street', are resolved. With the sequence of words established, the TTS system determines how the words are to be voiced. For some words, pronunciation depends on the part of speech. For instance, the word 'permits' is spoken with emphasis on the first syllable when it is used as a noun and on the second syllable when it is used as a verb. Synthesizers are able to handle all the ideal syncratic pronunciations of English, such as silent letters, proper names and words like 'permits' that can be pronounced in multiple ways.

In order to determine the part of speech of each word, the above-described TTS system uses a grammar parser. For example, the sentence 'permits cost $80/yr.' is parsed to: permits (noun) cost (verb) 80 (adjective) dollars (noun) per (preposition) year (noun). This sequence of words is then converted into phonemes to be used in proper selection of the corresponding speech units. The phonemes are referred to in the following as target phonetic elements.

Determining which recorded speech unit to select from the approximately 10,000 speech units stored for a target phonetic element in order to synthesize the corresponding part of the text is challenging. Each sound in a sentence varies slightly, depending on the sounds that precede and follow it, a phenomenon called co-articulation. The 'permits' example contains six individual phonemes. Because each of these six phonemes has about 10,000 original samples to choose from, about $10{,}000^6$ possible combinations would be possible. The enormous number of possible combinations makes it impossible to take all combinations into account and to determine the best matched combination of speech units, even in modem and fast computer systems.

The above-described TTS system therefore exploits a technique called dynamic programming to search the database efficiently and to determine the best fit. In order to correct any mismatch that occurs between adjacent phonetic elements or phonemes, the TTS system makes small pitch adjustments to correct the mismatch and thereby bends the pitch up or down at the edge of each sample in order to fit the phonetic element to that of its neighbor.

The TTS system determines and selects the speech units from the database by use of a cost function. That is, costs are calculated that define how closely a speech unit in question matches the target phonetic element predicted by the TTS system by determining the phoneme for a particular segment of the text or of the word. One part of these costs is based on segmental criteria such as phones and phone context. This part is referred to as (segmental) unit costs. Another part, the so called concatenation cost, is used to measure how closely a speech unit in question matches its adjacent speech units. The speech unit that provides the lowest cost is then selected for a target phonetic element.

The above-described TTS system provides good segment quality as the above-mentioned cost function ensures that the selected speech unit is the best match to the corresponding target phonetic element. However, prosody (patterns of alternating stressed and unstressed elements) and intonation in human speech is normally supra-segmental (that is, extends over more than one sound segment) with respect to phonemes and thus with respect to target phonetic elements and corresponding selected speech units. The prosody of the concatenated speech units therefore is still not optimal in comparison with human speech.

BRIEF SUMMARY OF THE INVENTION

The present invention may be implemented as a method for synthesizing speech for a given text. A sequence of phonetic components is established based on the given text. The sequence of phonetic components is used to establish a sequence of target phonetic elements. A sequence of target event types is established based on the sequence of target phonetic elements. Speech units are selected from a set of stored speech unit candidates with each speech unit being selected using a cost function comprising a unit cost determined with respect to the corresponding target phonetic element, a concatenation cost determined with respect to adjacent speech units, and an event type cost determined with respect to the corresponding target event type.

The present invention may also be implemented as a computer program product for synthesizing speech for a given text. The computer program product includes a computer usable medium embodying computer usable program code configured to determine a sequence of phonetic components from the given text, to determine a sequence of target phonetic elements from the determined sequence of phonetic components, to determine a sequence of target event types from the sequence of target phonetic components and to establish a sequence of speech units from a set of stored speech unit candidates. Each speech unit is selected using a cost function comprising a unit cost determined with respect to the corresponding target phonetic element, a concatenation cost determined with respect to adjacent speech units, and an event type cost determined with respect to the corresponding target event type.

Furthermore, the present invention may be implemented as an apparatus for synthesizing speech for a given text. The apparatus includes logical components for determining a sequence of phonetic components from the given text, for determining a sequence of target phonetic elements from the determined sequence of phonetic components, for determining a sequence of target event types from the sequence of target phonetic components, and for establishing a sequence of speech units from a set of stored speech unit candidates. Each speech unit is selected using a cost function including a unit cost determined with respect to the corresponding target phonetic element, a concatenation cost determined with respect to adjacent speech units, and an event type cost determined with respect to the corresponding target event type.

DETAILED DESCRIPTION OF THE INVENTION

Figure 1:
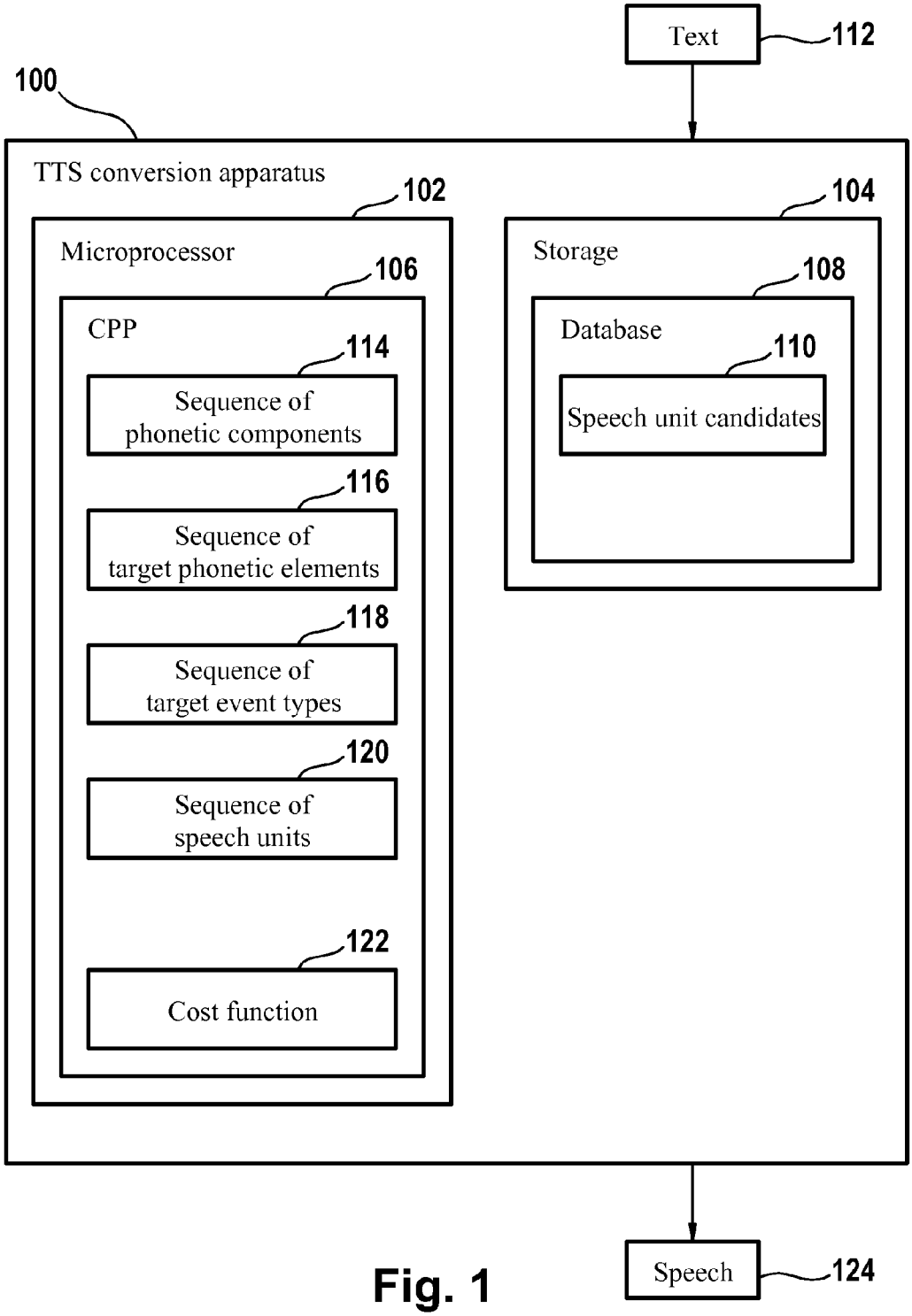
FIG. 1 is a block diagram of a TTS conversion apparatus.

As will be appreciated by one skilled in the art, the present invention may be embodied as a method, system, or computer program product. Accordingly, the present invention may take the form of an entirely hardware embodiment, an entirely software embodiment (including firmware, resident software, micro-code, etc.) or an embodiment combining software and hardware aspects that may all generally be referred to herein as a "circuit", "module" or "system". Furthermore, the present invention may take the form of a computer program product on a computer-usable storage medium having computer-usable program code embodied in the medium.

Any suitable computer usable or computer readable medium may be utilized. The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission media such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, propagate, or transport the program for use by or in connection with the instruction execution system, apparatus, or device. The computer-usable medium may include a propagated data signal with the computer-usable program code embodied therewith, either in baseband or as part of a carrier wave. The computer usable program code may be transmitted using any appropriate medium, including but not limited to the Internet, wireline, optical fiber cable, RF, etc.

Computer program code for carrying out operations of the present invention may be written in an object oriented programming language such as Java, Smalltalk, C++or the like. However, the computer program code for carrying out operations of the present invention may also be written in conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through a local area network (LAN) or a wide area network (WAN), or the connection may be made to an external computer (for example, through the Internet using an Internet Service Provider).

The present invention is described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, that execute via the processor of the computer or other programmable data processing apparatus, create means for implementing the functions/acts specified in the flowchart and/or block diagram block or blocks.

These computer program instructions may also be stored in a computer-readable memory that can direct a computer or other programmable data processing apparatus to function in a particular manner, such that the instructions stored in the computer-readable memory produce an article of manufacture including instruction means that implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide steps for implementing the functions/acts specified in the flowchart and/or block diagram block or blocks.

FIG. 1 shows a block diagram of a text to speech conversion apparatus 100. The text to speech conversion apparatus 100 includes a microprocessor 102 and a storage device 104. The microprocessor executes a computer program product 106 that is permanently stored on the storage device 104 and that is loaded into the microprocessor 102 for execution from the storage device 104. The storage device 104 stores a database 108 that includes a large number of speech unit candidates 110.

When a text 112 is provided to the text to speech conversion apparatus 100, e.g., by scanning the text 112, the computer program product 106 parses the text and establishes a sequence of phonetic components 114. The sequence of phonetic components 114 can, for example, relate to a sentence in the text 112. Furthermore, a sequence of target phonetic elements 116 is determined from the sequence of phonetic components 114. Additionally, the computer program product 106 establishes a sequence of target event types 118 from the sequence of phonetic components 114.

Then, speech unit candidates are selected from the plurality of stored speech unit candidates 110 such that a sequence of speech units 120 provides the lowest functional value for a cost function 122 specified in the computer program product 106.

The cost function 122 is a function of a unit cost, a concatenation cost, and an event type cost for each speech unit in the sequence of speech units 120. The unit cost of a speech unit is determined with respect to the corresponding target phonetic element. The concatenation cost is determined with respect to a corresponding pair of adjacent speech units. Furthermore, the event type cost of each speech unit is determined with respect to its target event type. The established sequence of speech units 120 represents the speech for the part of the text 112 for which the sequence of phonetic components 114 has been established. The synthesized speech 124 is then output by the text to speech conversion apparatus 100.

A linguistic model is used to determine the prosody of the text. The prosody describes all the supra-segmental properties of the speech corresponding to the text and covers intonation, rhythm, and focus in speech. Acoustically, prosody describes changes in the syllable length, loudness, pitch, and certain details of the form and structure of speech sounds. Once the prosody for the text is determined, the sequence of target event types can be determined for the sequence of phonetic components by taking into account the prosody.

Figure 2:
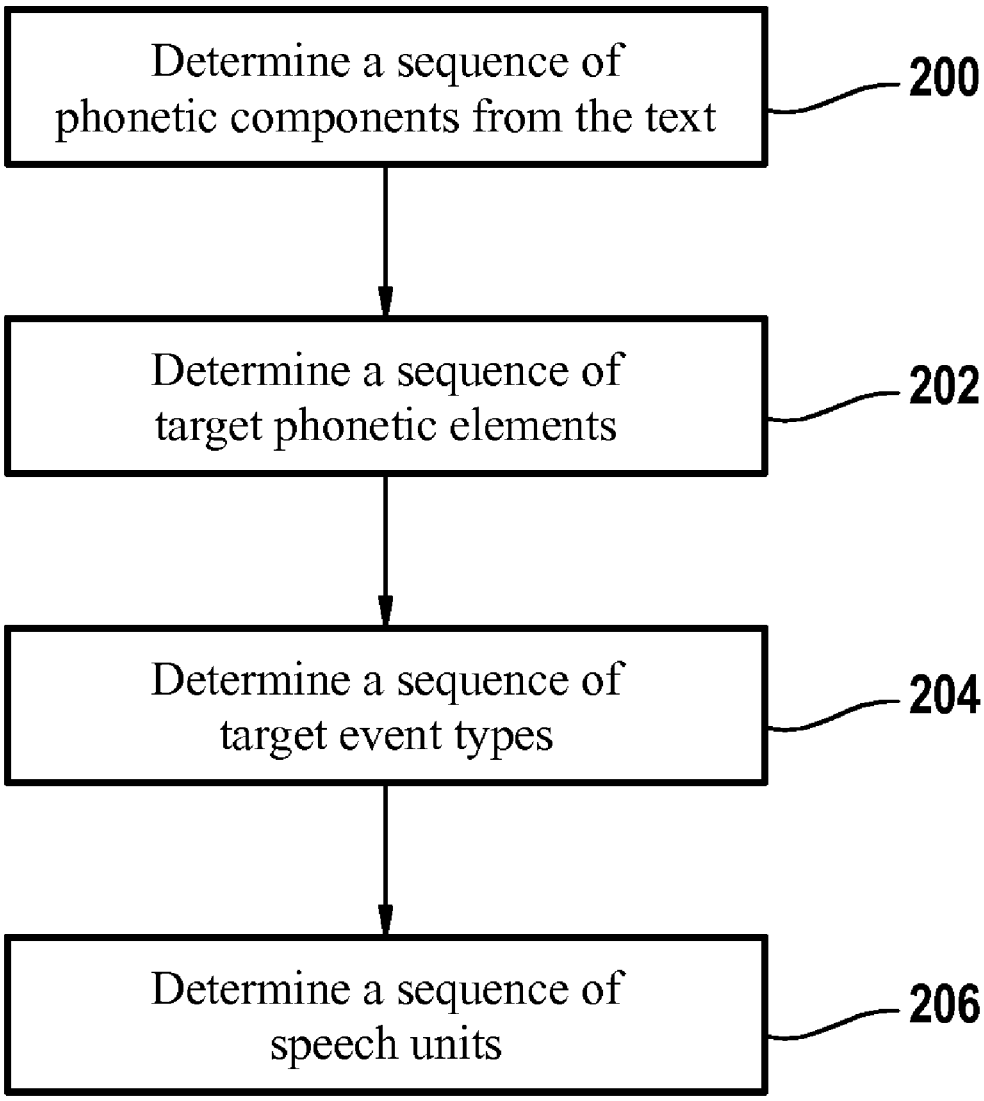
FIG. 2 is a flow diagram that illustrates basic steps performed by a method implemented in accordance with the invention.

FIG. 2 is a flow diagram that illustrates basic steps performed by a method of synthesizing speech from a given text in accordance with the present invention. In step 200, a sequence of phonetic components is established based on the given text. In step 202, a sequence of target phonetic elements is determined from the sequence of phonetic components. In step 204 a sequence of target event types is determined from the sequence of phonetic components. In step 206, a sequence of speech units is established by using a cost function to select speech units from a plurality of stored speech unit candidates. The cost function of the sequence of speech units provides the lowest functional value with respect to all other possible sequences of stored speech units determinable from the plurality of stored speech unit candidates.

Figure 3:
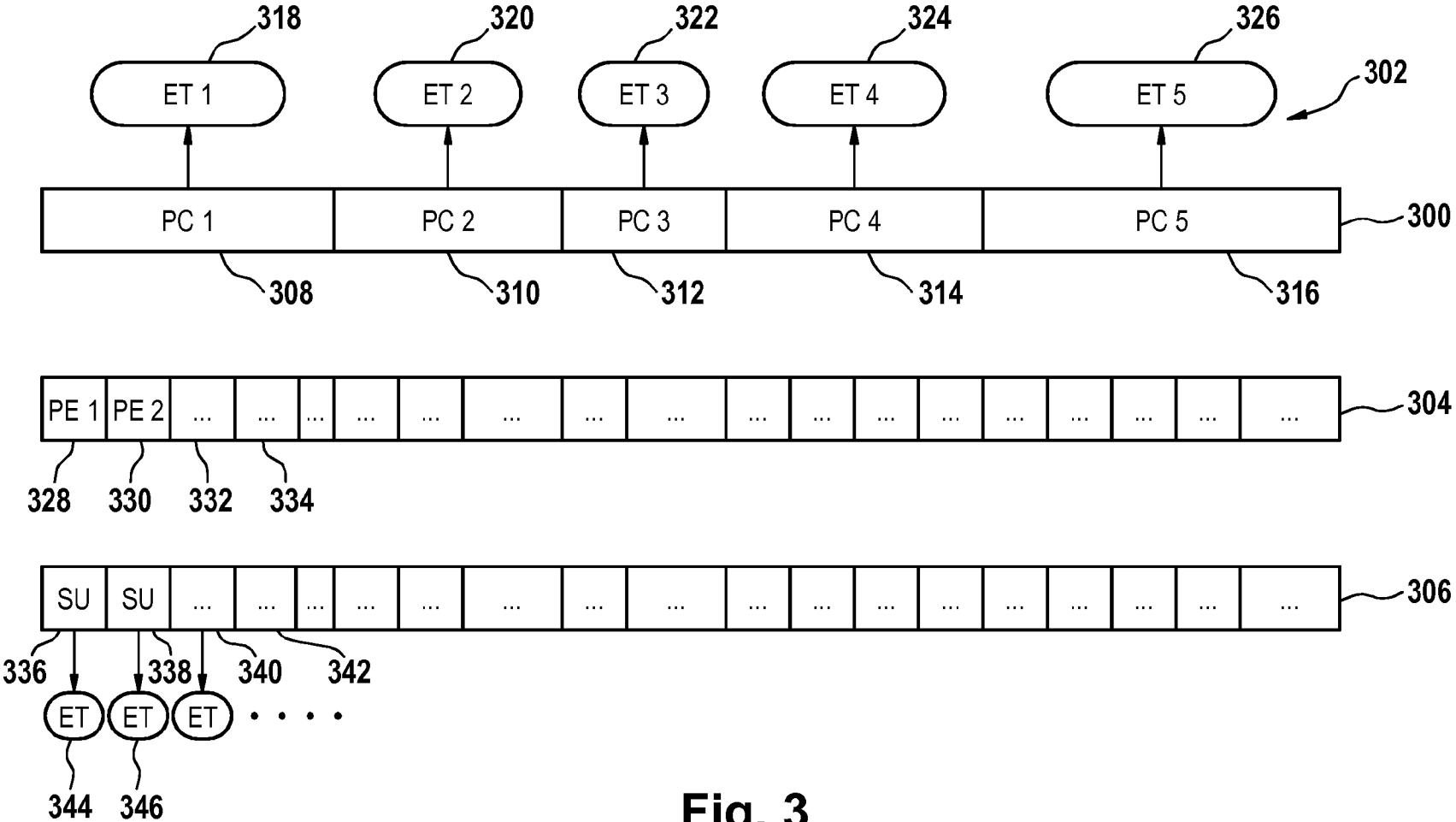
FIG. 3 shows schematically the relationship between phonetic components, target phonetic elements, event types and speech units.

FIG. 3 schematically shows the relationship between phonetic components, target phonetic elements, event types, and speech units. As already noted, a sequence 300 of phonetic components (PCs) is determined from a given text. The sequence 300 of phonetic components includes phonetic components 308 to 316. Each phonetic component 308 to 316 relates, e.g., to a word or to a syllable of a sentence in the text. A sequence 302 of target event types (ETs) is established for the sequence 300 of phonetic components. The sequence 302 of target event types includes target event types 318 to 326. Each of the event types 318 to 326 describes an intonation event for the corresponding phonetic component 308 to 316.

The target event types 318 to 326 are symbolized as ellipses in contrast to the rectangles used for the phonetic components 308 to 316 as each target event type specifies a specific intonation event for the corresponding phonetic component. The target event types 318 to 326 can, for example, be selected from a set of predetermined event types, wherein the set of predetermined event types provides event types that characterize basically all possible intonation events common to a particular speaker or to a particular language or set of languages. The set of predetermined event types also includes a so-called zero event type; that is an event type which describes no intonation and thus is unaccented and without boundary event.

The sequence 300 of phonetic components determines a sequence 304 of target phonetic elements including phonetic elements (PEs) 328, 330, 332, 334, etc. The target phonetic elements correspond to phonemes that form the basic building blocks for the corresponding phonetic components. For example, the target phonetic elements 328 to 334 represent the phonemes that make up the phonetic component 308.

The sequence 306 of speech units includes speech units (SU) 336 to 342, etc. The speech units are selected from a database such that the sequence 306 of speech units matches the sequence 302 of target event types and the sequence 304 of target phonetic elements. The selection of speech units is based on a cost function which takes into account unit costs, concatenation costs and event type costs. The unit cost of a speech unit is determined with respect to the corresponding target phonetic element. As an example, the unit cost for the speech unit 338 is determined with respect to the target phonetic element 330. The concatenation cost of a speech unit is determined with respect to the adjacent speech units. The concatenation cost of the speech unit 338 is for example determined with respect to the pairs 336, 338 and 338, 340 of adjacent speech units. Further, the event type cost of a speech unit is determined with respect to the corresponding target event type. For example, the event type cost for speech unit 338 is determined with respect to the target event type 318.

According to an embodiment of the invention, each speech unit can be associated with an event type. The speech unit 336 is, for example, associated with the event type 344 and the speech unit 338 is associated with the event type 346. The event types 344, 346 of the speech units 336, 338 can be determined such that they correspond to one of the target event types included in the set of predetermined event types. The associated event type 344 of the speech unit 338 is then compared with the target event type 318. Event type cost is considered low when there is a match between the compared event types but is considered high when there is no match between the compared event types.

Alternatively, the event type cost of an event type associated with a speech unit can be determined by taking into account the event type of the corresponding speech unit and the event types of the preceding speech units that are covered by the same target event type. For example, the event type cost of the event type 346 for the speech unit 338 is determined by taking into account the event type 346 of the speech unit 338 and the event type of the preceding speech units that fall within the same target event type. For this example, the event type 344 of speech unit 336 is taken into account in determining the event type cost of speech unit 338. This has the advantage that speech units that fall within an event type (e.g. speech units 336 to 342 that fall within the event type 318) reflect the intonation specified by the supra-segmental event type 318.

The sequence of speech units 306 for which the cost function including unit costs and event type costs of all speech units as well as the event type costs of the speech units provides the lowest functional value is the one that is used in generating synthesized speech for the corresponding text.

Each target event type of the sequence of target event types is selected from a set of pre-given event types, wherein each event type of the set of pre-given event types specifies a specific intonation event and/or relates to an accent type and/or a boundary type. The predetermined set of event types provides categories of different event types that allow describing perceptually important supra-segmental aspects in the speech such as intonation events and boundary events. One category of intonation events might therefore describe a falling pitch accent; another a rising pitch accent. A third example might be a rising pitch before a phrase boundary. The sequence of speech units selected by use of the cost function will thus follow the intonation and boundary events as specified by the sequence of target event types and hence properly reproduce the perceptually important aspects of the speech derived from the text.

Further, the target event types and consequently the sequence of target event types only specify the essence of an intonation movement, but not its exact realization. The target event types thus allow for several acceptable intonation realizations by the speech units. Since this imposes less prosody restriction on the requested speech units it is therefore easier to find speech units that allow both an acceptable intonation as well as high segmental quality. Event types may either be manually defined or derived from the analysis of an annotated speech corpus. In the latter case the annotation only describes where intonation events occur and the automated procedure clusters them into different categories that form the set of predetermined event types.

Each event type is associated with an event type description. The event type description provides a set of parameters for the (target) event type, wherein the set of parameters specifies the duration for the target event type, one change or a plurality of changes of a fundamental frequency over the duration of the target event type, and/or an intensity variation over the duration of the target event type. An event type description thus represents the essence of a corresponding event type in quantifiable terms.

Parametric descriptions are used to describe one single realization of a fundamental frequency movement. Event type descriptions as defined in this invention, however, go further and represent all possible fundamental frequency movements relating to one event type. Using the event type description and a suitable metric, as defined below, it is possible to evaluate the distance between two event types. Using a different metric, defined further below, it is possible to measure the distance between a particular fundamental frequency and a target event type in a general way. Event type descriptions are derived from a speech corpus annotated with event types providing a rich variety of fundamental frequency movements for each event type.

Figure 4:
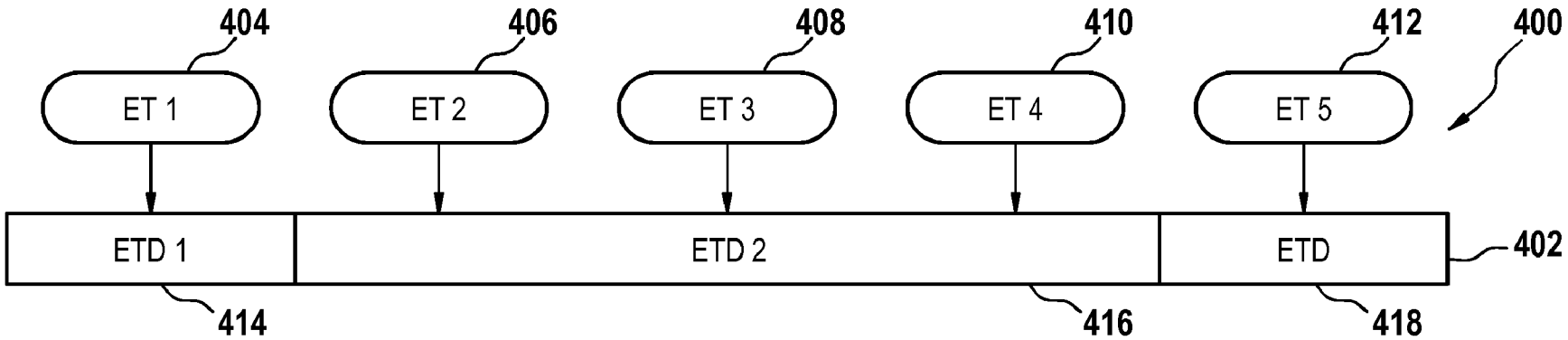
FIG. 4 shows schematically the relationship between a sequence of event types and a sequence of event type descriptions.

FIG. 4 shows schematically the relationship between a sequence 400 of target event types (ETs) and a sequence 402 of event type descriptions (ETDs). The sequence 400 of target event types includes event types 404 to 412. As mentioned before, the event types are chosen from a set of predetermined event types so that they reflect the intonation of the corresponding phonetic component. The event types provided in the set of predetermined event types are derived from a linguistic model so that basically all variants in the intonation of human speech are reflected.

The sequence 402 of event type descriptions includes event type description 414, 416 and 418. It is evident from FIG. 4 that the relationship between the target event types and the event type descriptions is not a one-to-one relation as the event type description 416 covers the event types 406, 408, and 410. The event type descriptions are derived from an annotated speech corpus and provide a set of parameters for the one or more target event types represented by an event type description. The set of parameters specify, for example, the duration of the target event, any changes in the fundamental frequency over the duration, and/or an intensity variation over the duration.

When an event type description relates to more than one event type, as is the case for the event type description 416, then at least one of the event types is not a zero event type. For example, the event types 406 and 410 can be zero event types, whereas the event type 408 is not a zero event type.

An event type description might, for example, be as follows: $f_0$, the fundamental frequency of the associated phonetic component starts rising 100 milliseconds after the start of the phonetic component, rises over 40 hertz, reaches its peak at 100 milliseconds after the start of the phonetic component and then falls over 60 hertz during 120 milliseconds.

Figure 5:
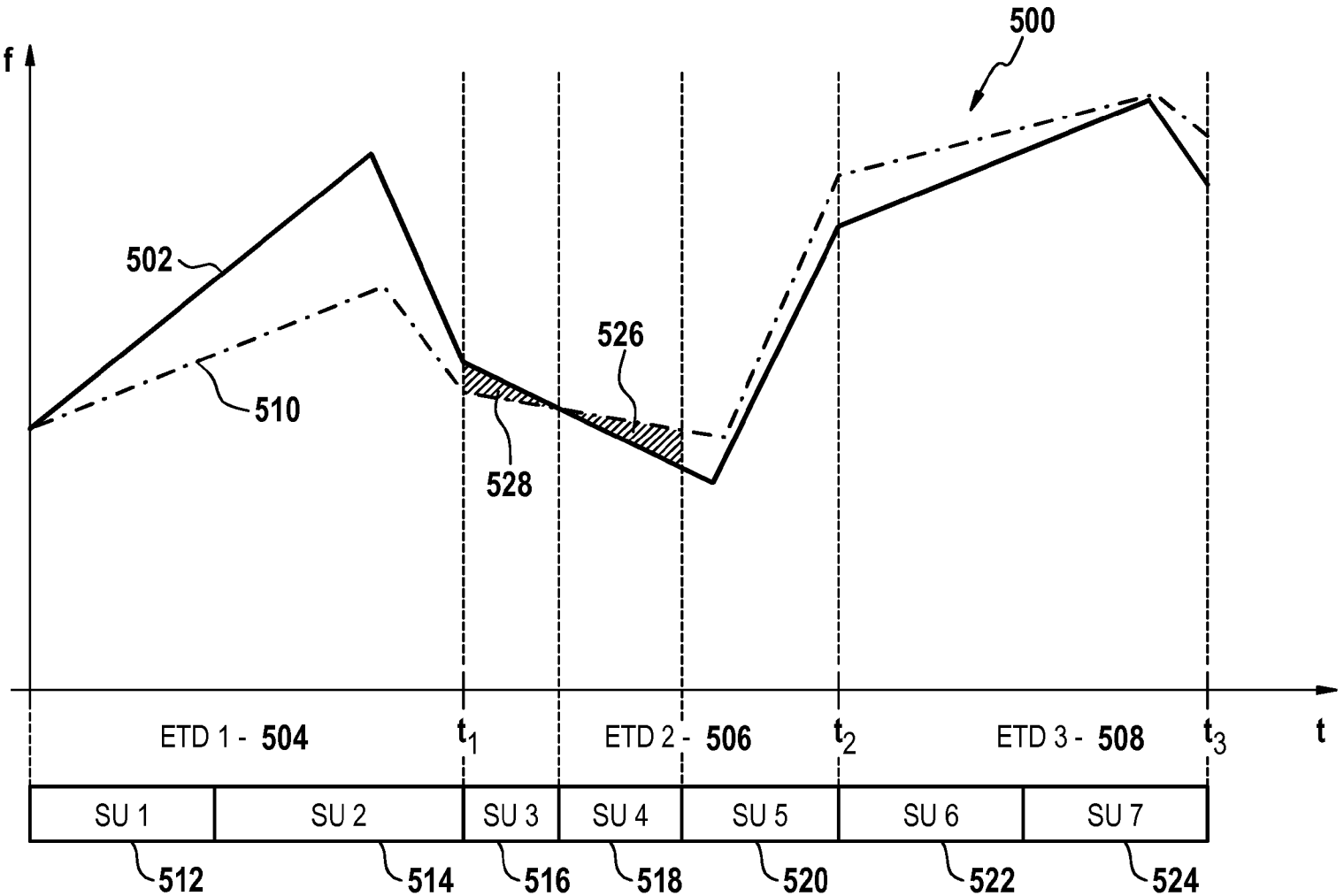
FIG. 5 is a graph that shows schematically the fundamental frequencies of a sequence of event type descriptions and of a sequence of speech units.

FIG. 5 shows graphs 500 that depict changes in a fundamental frequency 502 of a sequence of event type descriptions 504, 506, 508 and changes in a fundamental frequency 510 of a sequence of speech units 512 to 524 as a function of time. The event type description 504 specifies the changes in the fundamental frequency within the duration from zero to ti, the event type description 506 specifies changes in the fundamental frequency from $t_1$, to $t_2$ and the event type description 508 specifies changes in the fundamental frequency from $t_2$ to $t_3$.

The speech units 512 and 514 fall within the span of the event type description 504, the speech units 516, 518 and 520 fall within the span of the event type description 506 and the speech units 522 and 524 fall within the span of the event type description 508.

The event type cost of a speech unit can be determined by evaluating a distance between the speech unit and the event type description. The distance between a speech unit and the corresponding event type description can, for example, be determined by comparing and quantifying the changes in fundamental frequencies for the duration of the speech unit. For example the event type cost of speech unit 518 can be associated with the size of the area 526 enclosed by the frequencies 502 and 501 within the duration of the speech unit 518.

Alternatively, the event type cost of the speech unit 518 can be determined by taking into account other speech units that occur within the duration specified by the corresponding event type description. For example, the distance between the speech unit 518 and the event type description 506 can be associated with the sum of the sizes of both areas 526 and 528.

Figure 6:
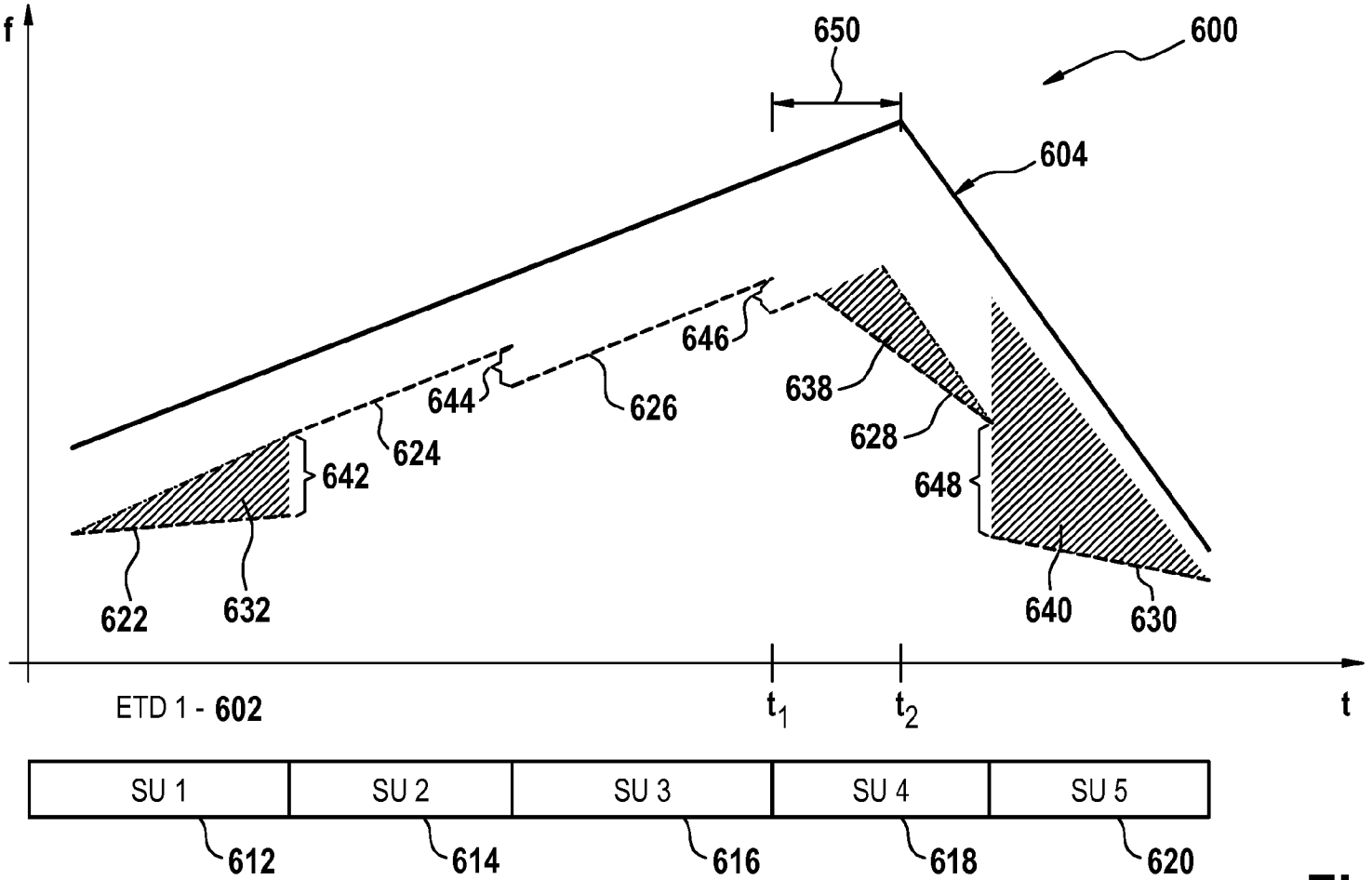
FIG. 6 is a graph that depicts changes in a fundamental frequency 604 of an event type description, and changes in fundament frequencies of a sequence of speech units as a function of time.

FIG. 6 shows graphs 600 that depict changes in the fundamental frequency 604 of an event type description 602, and changes in the fundament frequency 622 to 630 of a sequence of speech units 612 to 620 as a function of time. The event type description 602 would characterize the fundamental frequency as "constantly rising until $t_2$, then rapidly falling".

The event type cost of a sequence of speech units can be determined by evaluating the sum of distances between the speech units and the event type description. The distance between a speech unit and the corresponding event type description can be determined by comparing and quantifying changes in fundamental frequencies for the duration of the speech unit. For example, the event type cost of speech unit 612 can be determined based on the size of the area 632 enclosed by the gradients of frequencies 622 and 604 within the duration of the speech unit 612. Similarly, the event type costs of speech units 618 and 620 can be determined based on the sizes of the areas 638, 640 enclosed by the gradients of frequencies 628, 604 and 630, 604, respectively, within the duration of the corresponding speech units 618, 620.

Additionally, the time shift 650 between the peak of 604 at $t_2$ and the peak of 612 to 618 at $t_1$, can be included in the event type cost. Note that this part of the cost cannot be calculated for the sequence of speech units 612 to 616 as the peak is not yet reached during that sequence.

The jumps 642 to 648 of fundamental frequency are not to be included into the event type cost but are reflected in the concatenation cost of the sequence of speech units 612 to 620.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which includes one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to preferred embodiments thereof, it will be apparent that modifications and variations are possible without departing from the scope of the invention defined in the appended claims.

What is claimed is:

1. A method of synthesizing speech from text, the method comprising:

determining a sequence of phonetic components from the text;

determining a sequence of target phonetic elements from the determined sequence of phonetic components;

determining a sequence of target event types from the sequence of target phonetic components, wherein a target event type in the sequence of target event types represents a plurality of intonation realizations; and selecting a plurality of speech units from a set of stored speech unit candidates to form a sequence of selected speech units, wherein a first speech unit in the sequence of selected speech units is selected using a cost function comprising a unit cost determined with respect to the target phonetic element corresponding to the first speech unit, a concatenation cost determined with respect to at least one speech unit adjacent to the first speech unit, and an event type cost determined with respect to a target event type corresponding to the first speech unit.

2. The method according to claim 1, wherein each target event type is selected from a set of predetermined event types, wherein the set of predetermined event types was automatically derived from at least one annotated speech corpus.

3. The method according to claim 2, wherein each target event type is associated with an event type description that provides a set of parameters for the target event type, said set of parameters specifying at least one of the following: a duration for the target event type, one or more changes of the fundamental frequency over the duration of the target event type, and an intensity variation over the duration of the target event type.

4. The method according to claim 3, wherein the event type cost of a speech unit takes at least one of the following into account: a distance between the movement of the fundamental frequency of the speech unit and the movement of the fundamental frequency specified by the event type description of the corresponding event type and/or a distance between the intensity variation of the speech unit and the intensity variation specified by the event type description.

5. The method according to claim 3, wherein each speech unit is associated with an event type and the event type cost of a speech unit takes at least one of the following into account: a distance between the event type of the corresponding phonetic component, the event type of the speech unit and of one or more preceding speech units, and the event type of one or more adjoining speech units, related to the corresponding phonetic component.

6. The method according to claim 4, wherein said distance is evaluated using a perceptually-measured metric.

7. The method according to claim 3, wherein the event type cost of a speech unit takes into account a size of an area defined with respect to movement of the fundamental frequency in the event type description of the corresponding event type and the movement of the fundamental frequency in one or more speech units that fall within the duration specified by the event type description.

8. The method according to claim 7, wherein the distance is evaluated by use of a metric quantifying the distance between at least one of the following:

fundamental frequency movements of the speech unit, and intensity variations and a set of parameters of the corresponding target event type description.

9. The method of claim 2, wherein the set of predetermined event types was derived automatically from the at least one annotated speech corpus at least in part by using a clustering procedure.

10. A computer program product for synthesizing speech from text, said computer program product comprising at least one non-transitory computer usable medium having computer usable program code embodied therewith, said computer usable program code comprising:

computer usable program code configured to determine a sequence of phonetic components from the text;

computer usable program code configured to determine a sequence of target phonetic elements from the determined sequence of phonetic components;

computer usable program code configured to determine a sequence of target event types from the sequence of target phonetic components, wherein a target event type in the sequence of target event types represents a plurality of intonation realizations;

computer usable program code configured to select a plurality of speech units from a set of stored speech unit candidates to form a sequence of selected speech units, wherein a first speech unit in the sequence of selected speech units is selected using a cost function comprising a unit cost determined with respect to a target phonetic element corresponding to the first speech unit, a concatenation cost determined with respect to at least one speech unit adjacent to the first unit, and an event type cost determined with respect to a target event type corresponding to the first speech unit.

11. The computer program product according to claim 10, wherein said computer usable program code configured to determine a sequence of target event types from the sequence of target phonetic components further comprises computer usable program code configured to select each target event type from a set of predetermined event types, wherein the set of predetermined event types was automatically derived from at least one annotated speech corpus.

12. The computer program product according to claim 11, wherein each target event type is associated with an event type description that provides a set of parameters for the target event type, said set of parameters specifying at least one of the following: a duration for the target event type, one or changes of the fundamental frequency over the duration of the target event type, and an intensity variation over the duration of the target event type.

13. The computer program product according to claim 12 further comprising:

computer usable program code configured to associate each speech unit with an event type; and computer usable program code configured to determine the event type cost of a speech unit taking at least one of the following into account: a distance between the event type of the corresponding phonetic component, the event type of the speech unit and of one or more preceding speech units, and the event type of one or more adjoining speech units, related to the corresponding phonetic component.

14. The computer program product according to claim 13 further comprising computer usable program code configured to evaluate said distance using a perceptually-measured metric.

15. The computer program product according to claim 14, wherein said computer-usable program code configured to determine the event type cost of a speech unit comprises computer-usable program code that takes at least one of the following into account: a distance between the movement of the fundamental frequency of the speech unit and the movement of the fundamental frequency specified by the event type description of the corresponding event type and/or a distance between the intensity variation of the speech unit and the intensity variation specified by the event type description.

16. The computer program product according to claim 13 wherein the computer usable program code configured to determine the event type cost of a speech unit further comprises computer usable program code configured to take into account a size of an area defined with respect to movement of the fundamental frequency in the event type description of the corresponding event type and the movement of the fundamental frequency in one or more speech units that fall within the duration specified by the event type description.

17. The computer program product according to claim 16 wherein said distance is evaluated by use of a metric quantifying the distance between at least one of the following: fundamental frequency movements of the speech unit, and intensity variations and a set of parameters of the corresponding target event type description.

18. The computer program product of claim 11, wherein the set of predetermined event types was derived automatically from the at least one annotated speech corpus at least in part by using a clustering procedure.

19. An apparatus for synthesizing speech from text, the apparatus comprising:

a processor configured to perform a method comprising the acts of:

determining a sequence of phonetic components from the text;

determining a sequence of target phonetic elements from the determined sequence of phonetic components;

determining a sequence of target event types from the sequence of target phonetic components, wherein a target event type in the sequence of target event types represents a plurality of intonation realizations;

selecting a plurality of speech units from a set of stored speech unit candidates to form a sequence of selected speech units, wherein a first speech unit in the sequence of selected speech units is selected using a cost function comprising a unit cost determined with respect to a target phonetic element corresponding to the first speech unit, a concatenation cost determined with respect to at least one speech unit adjacent to the first speech unit, and an event type cost determined with respect to a target event type corresponding to the first speech unit.

20. The apparatus according to claim 19 wherein each target event type is selected from a set of predetermined event types, wherein the set of predetermined event types was automatically derived from at least one annotated speech corpus.

21. The apparatus according to claim 20, wherein each target event type is associated with an event type description that provides a set of parameters for the target event type, said set of parameters specifying at least one of the following: a duration for the target event type, one or changes of the fundamental frequency over the duration of the target event type, and an intensity variation over the duration of the target event type.

22. The apparatus according to claim 21, wherein the method comprises associating each speech unit with an event type and wherein the event type cost of a speech unit takes at least one of the following into account: a distance between the event type of the corresponding phonetic component, the event type of the speech unit and of one or more preceding speech units, and the event type of one or more adjoining speech units, related to the corresponding phonetic component.

23. The apparatus of claim 20, wherein the set of predetermined event types was derived automatically from the at least one annotated speech corpus at least in part by using a clustering procedure.

* * * * *